US009481008B2

(12) United States Patent
Zolli et al.

(10) Patent No.: US 9,481,008 B2
(45) Date of Patent: Nov. 1, 2016

(54) RECLAIM SEALER APPLICATION APPARATUS AND METHOD

(71) Applicant: Toyota Motor Engineering & Manufacturing North America, Inc., Erlanger, KY (US)

(72) Inventors: Frank Zolli, Brantford (CA); Matt Neal Jantzi, Baden (CA); Michael Haller, Kitchener (CA); Grant Daniel Balfoort, Brantford (CA)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 176 days.

(21) Appl. No.: 13/939,898

(22) Filed: Jul. 11, 2013

(65) Prior Publication Data

US 2015/0017332 A1 Jan. 15, 2015

(51) Int. Cl.

| | |
|---|---|
| ***B05C 11/10*** | (2006.01) |
| ***B05C 5/02*** | (2006.01) |
| *B05C 9/12* | (2006.01) |

(52) U.S. Cl.

CPC ..... *B05C 11/1039* (2013.01); *B05C 5/0216* (2013.01); *B05C 9/12* (2013.01); *Y10T 137/85954* (2015.04)

(58) Field of Classification Search

CPC ..... B05C 11/1039; B05C 9/12
USPC ..... 427/345
See application file for complete search history.

(56) References Cited

U.S. PATENT DOCUMENTS

| | | | | |
|---|---|---|---|---|
| 3,450,092 | A | 6/1969 | Kock | |
| 4,607,592 | A | 8/1986 | Richter | |
| 6,037,009 | A * | 3/2000 | Clare et al. | 427/207.1 |
| 6,391,271 | B1 * | 5/2002 | Debailleul | A62D 3/36 423/167.1 |
| 2004/0060510 | A1 | 4/2004 | Ciarelli et al. | |
| 2010/0206341 | A1 * | 8/2010 | Essenburg et al. | 134/45 |
| 2012/0308732 | A1 * | 12/2012 | Chiang et al. | 427/421.1 |

* cited by examiner

*Primary Examiner* — Alexander Weddle
(74) *Attorney, Agent, or Firm* — Christopher G. Darrow; Darrow Mustafa PC

(57) ABSTRACT

An apparatus and method for supplying virgin sealer and reclaim sealer to a sealer applicator. A closed loop path including a first fluid flow path is coupled between a source of virgin sealer and the applicator and includes a recirculation path from the applicator back to the source of virgin material. A reclaim sealer supply is coupled to the first fluid flow path. Valves open and close the virgin sealer supply and the reclaim sealer supply to alternately supply virgin sealer or reclaim sealer to the applicator. Whenever the first fluid flow path contains reclaim sealer, a valve blocks flow to the recirculation path to prevent reclaim sealer from being recirculated into the source of virgin sealer.

9 Claims, 4 Drawing Sheets

RECLAIM SEALER APPLICATION APPARATUS AND METHOD

BACKGROUND

This specification relates, in general, to vehicle sealer application systems.

Flowable sealer material is applied to various locations in a vehicle body during vehicle assembly such as to panel and to seal gaps between welded or fastened panels. The sealer is a flowable material applied by robot applicators or by operator manipulated applicators.

Excess applied sealer is removed for quality purposes by manual scraping. The excess sealer is stored in barrels and then disposed of following toxic material disposal procedures.

The excess sealer constitutes a hazardous waste and thereby poses hazardous waste generation and disposal issues. In addition, the cost of the excess waste sealer is lost money affecting the overall cost of manufacturing the vehicle.

There is a need to provide a method for recycling the excess sealer which reduces hazardous waste generation and provides a significant sealer material cost savings.

SUMMARY

An apparatus for supplying virgin sealing material and reclaim sealing material through a supply path to an applicator is disclosed.

The apparatus for applying sealing material through an applicator to a surface includes a source of virgin applied material sealer, a closed loop fluid flow pathway for supplying virgin material to the applicator and an excess recirculation path from the applicator to the source of virgin sealer. A first valve is positioned in the closed loop pathway to block the virgin sealer flow through a first portion of the closed loop pathway. A second valve is coupled in the closed loop pathway to control the flow of sealer through the recirculation path back to the source of virgin sealer. A source of reclaim sealer is coupled to a multi input node or the connection disposed in fluid flow communication with the closed loop pathway. A third valve is disposed in the supply path between the source of reclaim sealer and the node for controlling the flow of reclaim sealer to the node. A control controls the first valve, the second valve, and the third valve to selectively supply virgin sealer and reclaim sealer to the applicator while blocking recirculation of the reclaim sealer through the recirculation path to the source of virgin sealer.

The control operates to open the first valve, to open the second valve and to close the third valve to supply virgin sealer from the source of virgin sealer through the closed loop pathway, through the node to the applicator and then through the second valve and the recirculation path back to the source of virgin sealer.

The control operates to close the first valve, close the second valve and open the third valve to supply reclaim sealer from the source of reclaim sealer through the node and a first flow path portion of the close loop pathway to the applicator.

The control operates, after closing the third valve and opening the first valve, to maintain the second valve closed until all of the reclaim sealer in the first fluid flow path of the closed loop path is discharged through the applicator.

A method of supplying virgin sealer and reclaim sealer to a vehicle body includes providing a virgin sealer fluid flow loop to an applicator including a first fluid flow path from a source of virgin material to the applicator and a recirculation path of virgin sealer from the applicator back to the source of virgin sealer, supplying reclaim sealer from a source of reclaim sealer through a portion of the first fluid flow path to the applicator, while blocking the recirculation flow path from recirculating reclaim sealer.

The method includes coupling a first valve between the source of virgin sealer in the first fluid flow loop, coupling a second valve in fluid flow communication between the applicator, the first fluid flow loop and the recirculation path, coupling a third valve in fluid flow communication between the source of reclaim sealer and the first fluid flow loop.

The method includes controlling the opening and closing of the first valve, the second valve, and the third valve by opening the first valve and the second valve to allow flow of virgin sealer for the source of virgin sealer in the first fluid flow path to the applicator and back through the recirculation path to the source or virgin sealer while blocking flow or reclaim sealer through the portion of the first fluid flow loop.

The control also controls the opening and closing of the first valve, the second valve, and the third valve to allow flow of reclaim sealer to a portion of the first fluid flow loop to the applicator while blocking flow of reclaim sealer through the recirculation path.

The control closing the third valve to block flow of reclaim sealer into the first fluid flow loop, opening the first valve to allow flow of virgin sealer through the first fluid flow loop, and maintaining the third valve in a closed position blocking flow through the recirculation path until the first fluid flow path is clear of reclaim sealer.

The supply of virgin sealer when flowing through the first fluid flow loop forces the reclaim sealer through the first fluid flow loop to the applicator.

The method also couples at least one filter in a reclaim sealer supply path between the source of reclaim sealer and the connection to the first fluid flow path.

The method includes applying virgin sealer and reclaim sealer applied to a vehicle body by a robotic controlled applicator.

BRIEF DESCRIPTION OF THE DRAWING

The various features, advantages, and other uses of the present reclaim sealer application apparatus and method will become more apparent by referring to the following detailed description and drawing in which:

DETAILED DESCRIPTION

Figure 1:
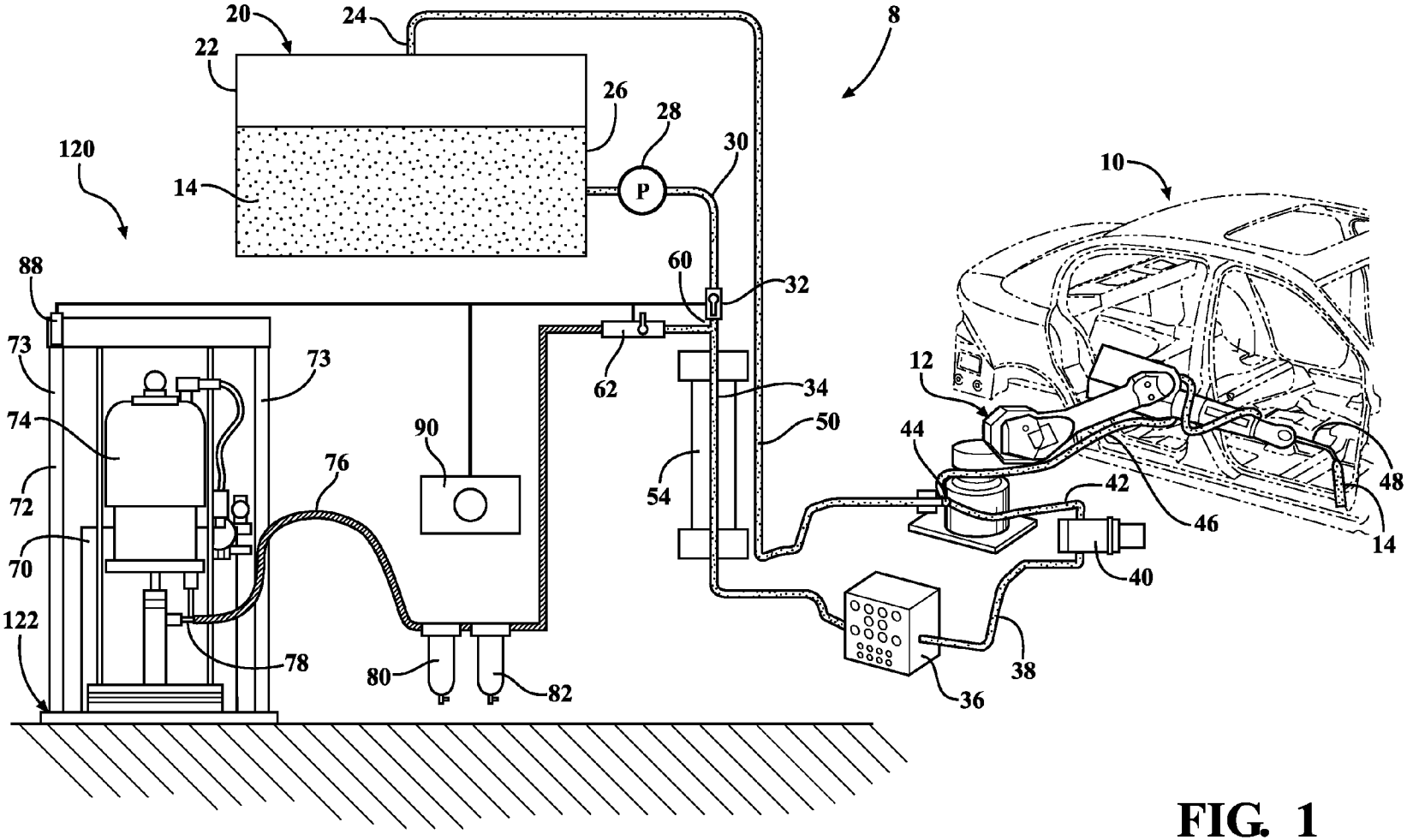
FIG. 1 is a pictorial representation of a vehicle sealer application system employing a reclaim sealer system and showing the virgin sealer and reclaim sealer systems in a virgin sealer application mode.
Figure 2:
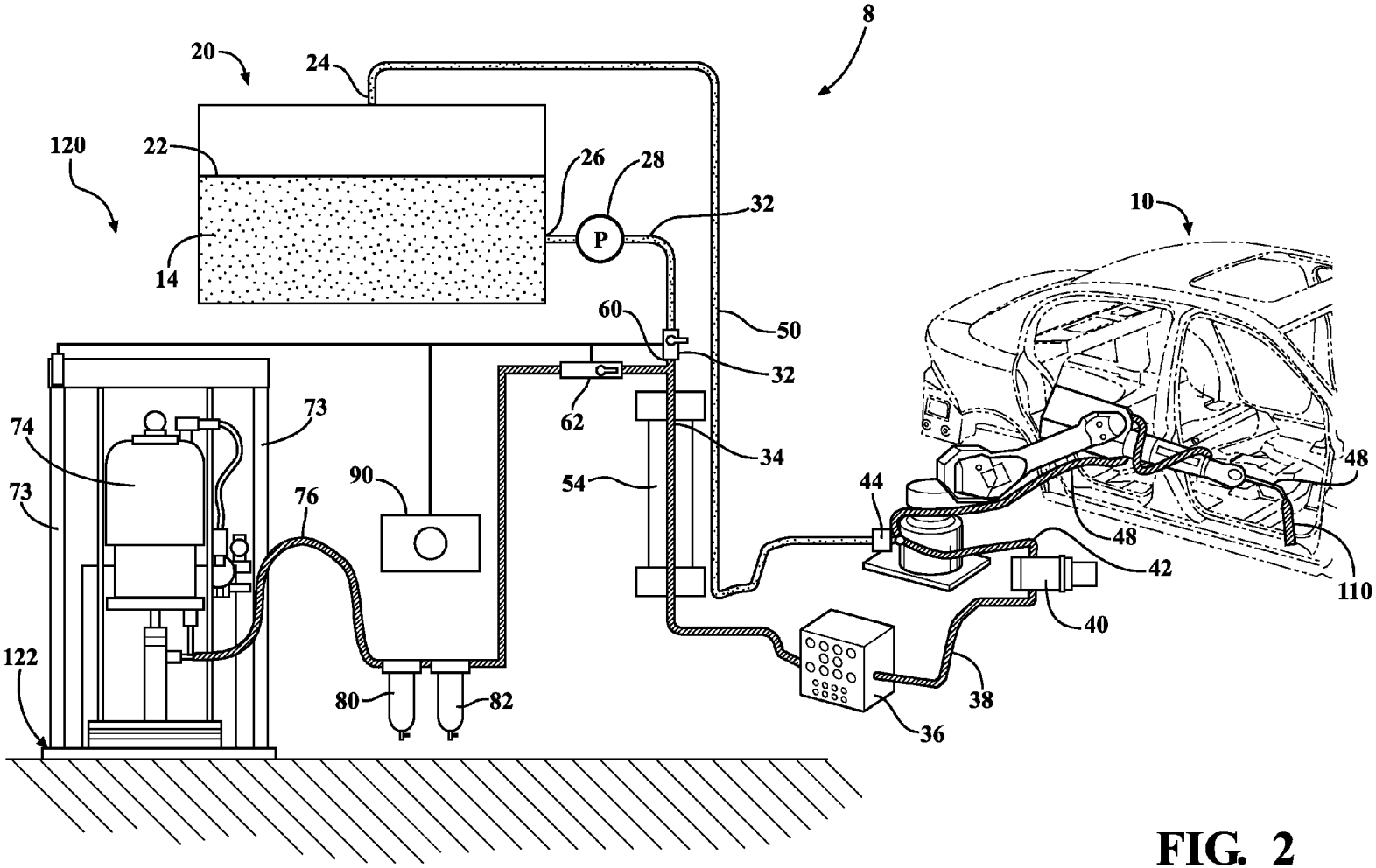
FIG. 2 is a pictorial representation, similar to FIG. 1, but showing the virgin sealer and reclaim sealer systems in a reclaim sealer application mode.
Figure 3:
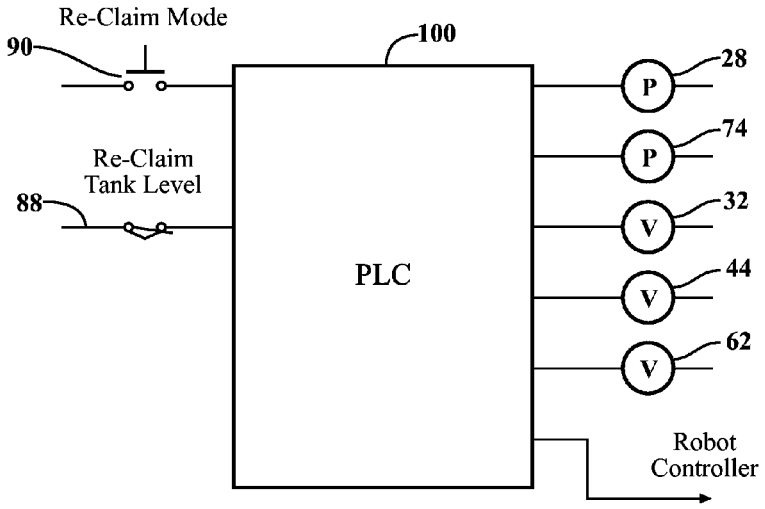
FIG. 3 is a schematic diagram of controller for controlling the sealer application apparatus shown in FIGS. 1 and 2.

Referring now to to the drawing, and to FIGS. 1-3 in particular, there is depicted a vehicle virgin and reclaim sealer application apparatus 8 and method.

Flowable sealer material is applied to various locations in a vehicle body 10 during vehicle assembly by a manual applicator, not shown, and/or by a robotic controller applicator 12. FIGS. 1 and 2 depict a robotic sealer applicator 12, hereafter "applicator 12," located on one side of the vehicle body 10. It will be understood, that a vehicle assembly operation can have a pair of robotic sealer applicators 12 located on opposite sides of the vehicle body 10 for applying sealer material to the similar locations on opposite sides of the vehicle body, such as rocker seams, floor seams, door seams, etc.

By way of example only, the sealer application apparatus 8 includes a source 20 of virgin sealer 14. The virgin sealer source 20 will typically include a refillable tank 22 having an inlet 24 and an outlet 26. A pump 28 is coupled in fluid communication with fluid flow lines or conduits coupled to the tank outlet 26 for discharging virgin sealer 14 from the tank 22 to the applicator 12.

The virgin sealer applicator apparatus 8 includes a closed loop flow path formed of conduits or pipe extending from the outlet 26 of the tank 22 through the pump 28, a first supply line 30, a first controllable valve 32 for opening and closing fluid flow from the first supply line 30 to a second supply line 34, a node or tee connector 60 in the first supply line 30, a mastic regulator 36, a third supply line 38 extending from the mastic regulator 36 to a pump 40, which may be a gear pump, a fourth supply line 42 extending from the pump 40 to a two position controllable second valve 44 and finally to a fifth supply line 46 extending from the second valve 44 to an actuator 48 on the robot applicator 12. The closed loop flow path also includes a sixth supply line 50 hereafter referred to as a recirculation line extending in fluid flow communication between the second valve 44 and the inlet 24 of the tank 22.

The closed loop pathway includes a first fluid flow path including the tee connection 60, the second supply line 34, the third supply line 38, the fourth supply line 42 and the fifth supply line 46, defined between the first valve 32, the second valve 44 and the third valve 62.

In operation, with the first and second valves 32 and 44 disposed in an open fluid flow position, virgin sealer 14 is discharged from the tank 22 by the pump 28 through the first and second supply lines 30 and 34, the mastic regulator 36, the third supply line 38, the pump 40, the fourth supply line 42, through the second valve 44 and the fifth supply line 46 to the applicator 48. Excess sealer is recirculated through the second valve 44 and the sixth supply line 50 back to the tank or source of virgin sealer material 22. Also shown in FIG. 1, a heat exchanger 54 is disposed in heat transfer relationship with the second supply line 34 for controlling the temperature of the sealer flowing through the closed pathway loop.

The stippled symbols in the closed loop pathway depict virgin sealer flowing through the closed loop path in a first mode of sealer application to the vehicle body 10.

A reclaim sealer supply loop is coupled in fluid flow communication with the first fluid flow via a node or tee connection 60 between short length supply lines disposed in fluid flow communication with the first valve 32 and a third valve 62.

The reclaim sealer apparatus includes a barrel or container 70 containing reclaim sealer which is mountable in a stand 72, described in greater detail with reference to FIG. 4, a pump 74 and a supply line or conduit 76 extending from an outlet 78 through first and second replaceable filters 80 and 82 to the third valve 62.

The reclaim sealer apparatus also includes a level switch, such as proximity switch 88, mounted on the stand 72 for detecting the level of reclaim sealer in the barrel 70. A push button or other input actuator 90 is also provided in the reclaim sealer supply loop for initiating the flow of reclaim sealer from the the reclaim sealer barrel 70 to the robotic controlled actuator 48 as described hereafter.

As shown in FIG. 3, control 100, such as a programmable logic controller (PLC), is provided for controlling the virgin sealer supply loop and the reclaim sealer supply loop and interfaces with a robot controller for the robot 12. Inputs to the control 100 include the reclaim tank level switch 88 and the reclaim mode actuator push button 90.

Outputs controlled by the controller 100 include the first virgin sealer pump 28, the second reclaim sealer pump 74, the first valve 32, the second valve 44 and the third valve 62.

Operation of the sealer apparatus 8 and method will start with application of virgin sealer to the vehicle body 10. As shown in FIG. 1, the pump 28 is actuated by the control 100 to discharge virgin sealer 14 from the tank 22. The control 100 opens the first valve 32 and the second valve 44 to allow the pump 28 to force virgin sealer 14 through the first and second supply lines 30 and 32, through the mastic regulator 36, the third supply line 38 and to the gear pump 40. The pump 40 pumps the virgin sealer through the fourth supply line 42, the fifth supply line 46 to the robot controlled applicator 48 where the virgin sealer 14 is applied to selected locations on the vehicle body 10. Any excess virgin sealer 14 in the closed loop pathway is recirculated in the recirculation supply line 50 through the second valve 44 back to the tank 22. As noted above, the stippling in FIG. 1 shows the virgin 14 sealer in the closed loop supply 10.

When it is desired to use the reclaim sealer in the barrel 70, an operator depresses the push button 90 which, as an input to the control 100, causes the control 100, when executing a stored control program, to open the third valve 62 and close the first valve 32 and the second valve 44. Closure of the second valve 44 closes the recirculation supply line 50 thereby blocking reclaim sealer from flowing through the second valve 44 and the recirculation supply line 50 back to the virgin sealer tank 22. When the reclaim sealer pump 74 is activated by the control 100, the pump 74 causes reclaim sealer to flow from the barrel 70 through the supply line 76, through the filters 80 and 82 which may have different mesh filter sizes, such as 60 mesh for the first filter 40 in line and a smaller 60 mesh in the second filter 82. The cross hatching shown in FIG. 2 depicts the reclaim sealer flowing through the supply line 76, the third valve 62, through the connection 60 into a portion of the first fluid flow path including the second supply line 34, the mastic regulator 36, the third supply line 38, the pump 40, the fourth supply line 42 and the fifth supply line 46 to the applicator 48 which discharges reclaim sealer denoted by reference number 110 onto selected locations on the vehicle body 10. Since the second valve 44 is closed to fluid flow, the reclaim sealer cannot enter the recirculation supply line 50 and is thereby prevented from contaminating the virgin sealer source tank 22. It will be noted that there will be a transition period whereby the sealer application apparatus changes over from virgin sealer to reclaim sealer and back to virgin sealer. At the start of the transition period, as shown in FIG. 1, the controller 100 closes the first valve 32, and the second valve 44, while opening the third valve 62. However, the tee connection 60, the first supply line 34, the second supply line 38, the pump 40, the third supply line 42, the fourth supply line 46, the fifth supply line 46 as well as the applicator 48 will be filled with virgin sealer. The flow of reclaim sealer through the supply line 76 to the tee connection 60 will then force the remaining virgin sealer in the first fluid flow path out through the applicator 48 onto vehicle body 10 until all of the virgin sealer has been discharged from the first fluid flow path and only reclaim sealer 48 remains in the first supply line 34, the second supply line 38, the third supply line 42, the fourth supply line 46, the fifth supply line 46, and the applicator 48 as shown in FIG. 2.

A similar transition occurs when the level switch 88 detects that the level of reclaim sealer 70 has reached a low level. At this time, the control 100 closes the third valve 62 and opens the first and second valves 32 and 44. However, the first, second, third, fourth and fifth supply lines 30, 34, 38, 42, and 46 as well as the applicator 48 still contain reclaim sealer, as shown in FIG. 2. Subsequently, the virgin sealer flowing through the first valve 32 and tee connection 60 will force the reclaim sealer remaining in the supply lines out on onto the vehicle body until all of the reclaim sealer shown in FIG. 2 has been discharged from the first fluid flow path leaving only virgin sealer in the supply lines as shown in FIG. 1.

Figure 4:
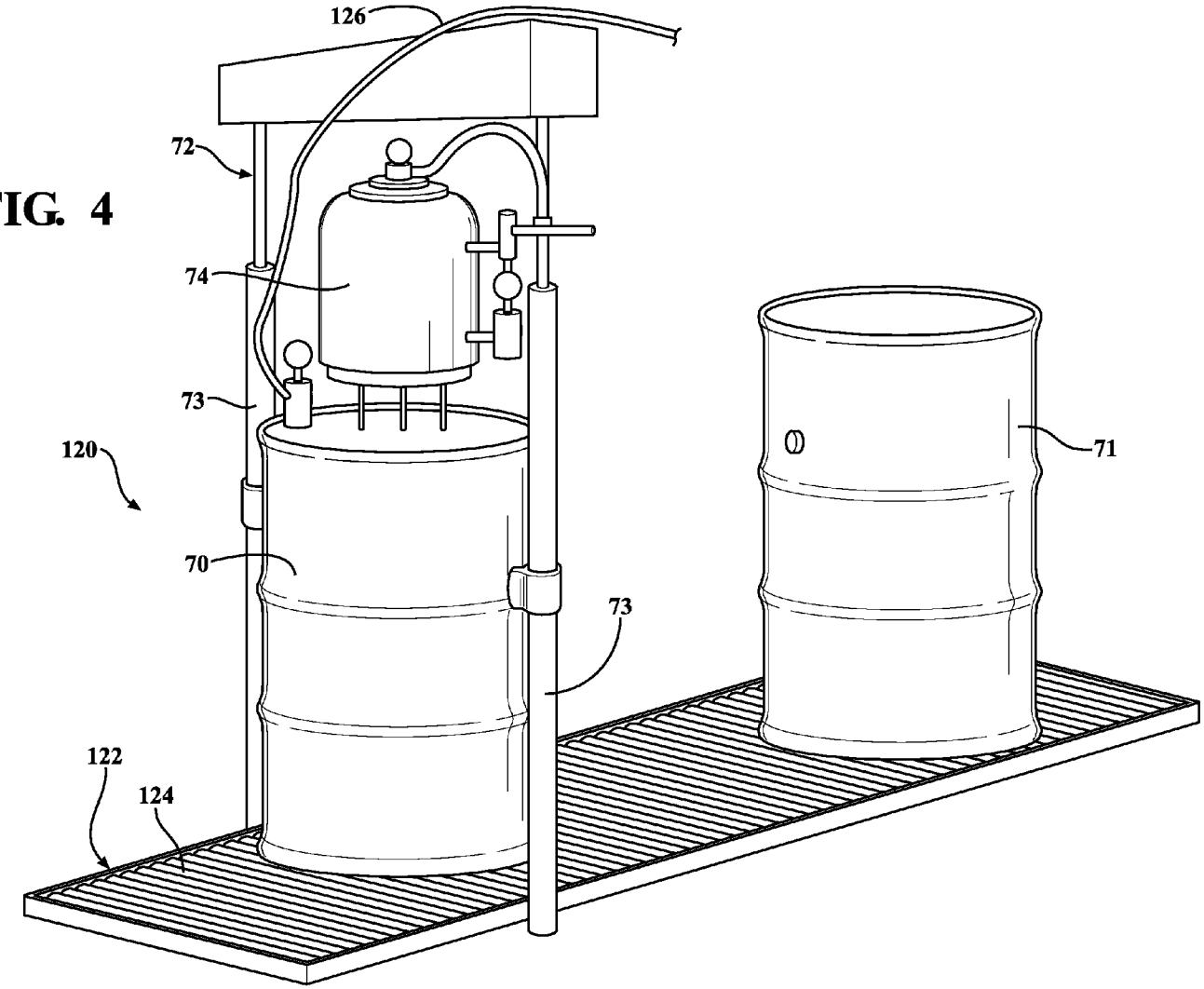
FIG. 4 is a perspective view of a reclaim sealer barrel change-out apparatus.

Referring now to FIG. 4, there is depicted a changeover apparatus 120 for simplifying the changeover of the barrel 70 of reclaim sealer when the one barrel 70 is exhausted of reclaim sealer with a new barrel 71 filled with reclaim sealer.

As shown in FIG. 4, the stand 72 includes a pair of vertically extending legs 73 mounted on opposite sides of a frame 122. The frame 122 includes a plurality of parallel rollers 124 which simplify the movement and exchange of an empty barrel 70 of reclaim sealer with a new full barrel 71 of reclaim sealer. During the barrel changeover, the fluid connections from the pump 74, the air pressure line 126, etc., are disconnected from the barrel 70 and the barrel 70 is slid along the rollers 124 out of the stand 72. The new barrel 71 is then rolled into the stand 72 and connected to the pump 74 and the regulated airline 126 as well as other fluid connections necessary to pump reclaim sealer from the barrel 71 to the discharge line 76.

What is claimed is:

1. An apparatus for alternatingly supplying sealing material from two sources to an applicator, the apparatus comprising:

an applicator;

a supply line coupled to the applicator;

a source of virgin sealer having an inlet and an outlet;

a source of reclaim sealer;

a first fluid flow path in fluid communication with each of: (1) the source of virgin sealer, (2) the source of reclaim sealer, and (3) the supply line coupled to the applicator, the first fluid flow path configured to alternatingly:

supply virgin sealer from the outlet of the source of virgin sealer to the supply line coupled to the applicator, and supply reclaim sealer from the source of reclaim sealer to the supply line coupled to the applicator;

a recirculation fluid flow path for recirculating excess virgin sealer, the recirculation fluid flow path extending from an end portion of the first fluid flow path to the inlet of the source of virgin sealer; and a two position controllable valve positioned between the end portion of the first fluid flow path and the recirculation fluid flow path, the valve configured for: (1) selectively directing the excess virgin sealer through the recirculation fluid flow path, without passing through the supply line coupled to the applicator, when virgin sealer is flowing through the first fluid flow path; and (2) selectively blocking the recirculation fluid flow path when reclaim sealer is flowing through the first fluid flow path, thereby blocking any recirculation of reclaim sealer to the source of virgin sealer.

2. An apparatus for selectively supplying virgin sealing material and reclaim sealing material to an applicator, the apparatus comprising:

a source of virgin sealer having an inlet and an outlet;

a first fluid flow path for supplying virgin sealer from the source of virgin sealer to a supply line coupled to the applicator;

a recirculation path for directing excess virgin sealer from an end portion of the first fluid flow path back to the source of virgin sealer without passing through the supply line coupled to the applicator;

a first valve positioned in the first fluid flow path to control a flow of virgin sealer through a first portion of the first fluid flow path;

a second valve positioned in the first fluid flow path to control a flow of excess virgin sealer through the recirculation path to the source of virgin sealer;

a source of reclaim sealer;

a supply path from the source of reclaim sealer to a node disposed in fluid flow communication with the first fluid flow path;

a third valve positioned in the first fluid flow path between the source of reclaim sealer and the node to control a flow of reclaim sealer through the node;

a control executing a control program to operate the first valve, second valve, and the third valve to selectively supply virgin sealer and reclaim sealer to the applicator without recirculation of the reclaim sealer through the recirculation path to the source of virgin sealer wherein execution of the control program selectively blocks recirculation of the reclaim sealer to the source of virgin sealer.

3. The apparatus of claim 2 wherein:

the control operates to open the first valve, to open the second valve, and to close the third valve to direct a flow of virgin sealer from the source of virgin sealer through the first fluid flow path and the node to the applicator, and then direct excess virgin sealer through the second valve and the recirculation path to the source of virgin sealer.

4. The apparatus of claim 2 wherein:

the control operates to close the first valve, to close the second valve, and to open the third valve to direct a flow of reclaim sealer from the source of reclaim sealer through the node and the first fluid flow path to the applicator.

5. The apparatus of claim 4 wherein:

the control, closing the third valve and opening the first valve, is configured to maintain the second valve in a closed position until all of the reclaim sealer in the first fluid flow path is discharged through the applicator.

6. The apparatus of claim 1 further comprising a reclaim sealer changeover apparatus, the changeover apparatus comprising:

a first container for storing reclaim sealer;

a second container for storing reclaim sealer; and a support frame for supporting the first container and the second container.

7. The apparatus of claim 6 wherein the support frame comprises a plurality of parallel rollers configured to allow the first and second containers to slide along a length of the support frame.

8. The apparatus of claim 1 further comprising a control configured to operate a plurality of valves to selectively:

supply virgin sealer to the applicator and recirculate excess virgin sealer through the recirculation fluid flow path back to the source of virgin sealer; and supply reclaim sealer to the applicator without recirculation of the reclaim sealer through the recirculation fluid flow path.

9. The apparatus of claim 1 further comprising:

a supply path from the source of reclaim sealer to a node disposed in fluid flow communication with the first fluid flow path.

* * * * *